US008736591B2

(12) United States Patent
Yamashita

(10) Patent No.: US 8,736,591 B2
(45) Date of Patent: May 27, 2014

(54) DISPLAY DEVICE USING PIXEL MEMORY CIRCUIT TO REDUCE FLICKER WITH REDUCED POWER CONSUMPTION

(75) Inventor: Keitaro Yamashita, Miao-Li County (TW)

(73) Assignee: Chimei Innolux Corporation, Miao-Li County (TW)

( * ) Notice: Subject to any disclaimer, the term of this patent is extended or adjusted under 35 U.S.C. 154(b) by 185 days.

(21) Appl. No.: 13/278,538

(22) Filed: Oct. 21, 2011

(65) Prior Publication Data

US 2012/0127215 A1 May 24, 2012

(30) Foreign Application Priority Data

Oct. 25, 2010 (JP) ..... 2010-238669

(51) Int. Cl.

*G09G 3/36* (2006.01)
*G06F 3/038* (2013.01)
*G09G 5/00* (2006.01)

(52) U.S. Cl.

USPC ..... 345/210; 345/209; 345/204; 345/690; 345/87; 345/92; 345/95

(58) Field of Classification Search

USPC ..... 345/87–105, 204–215, 501, 690–694, 345/560

See application file for complete search history.

(56) References Cited

U.S. PATENT DOCUMENTS 5,847,687 A * 12/1998 Hirakata et al. ..... 345/96
6,778,162 B2 * 8/2004 Kimura et al. ..... 345/90
6,967,649 B2 * 11/2005 Sun ..... 345/211
7,230,597 B2 * 6/2007 Edwards et al. ..... 345/87
7,375,706 B2 * 5/2008 Shih et al. ..... 345/87
7,952,546 B2 * 5/2011 Sano ..... 345/87
8,421,807 B2 * 4/2013 Yamashita ..... 345/501

(Continued)

FOREIGN PATENT DOCUMENTS

JP 2007-328351 12/2007
TW 516243 1/2003

(Continued)

OTHER PUBLICATIONS

English language translation of abstract of JP 2007-328351 (published Dec. 20, 2007).

(Continued)

*Primary Examiner* — Dwayne Bost
*Assistant Examiner* — Darlene M Ritchie
(74) *Attorney, Agent, or Firm* — McClure, Qualey & Rodack, LLP

(57) ABSTRACT

A display device where a memory circuit is installed into each pixel without generating flicker, including a plurality of pixels arranged in a matrix, wherein each pixel has a light-transmissive element controlling the amount of transmissive light in response to a voltage difference between a first electrode and a second electrode, a memory circuit storing the voltage level of the first electrode, and a controller. In the case where the first electrode has a positive voltage level with respect to the second electrode at a refreshing timing, the controller makes the memory circuit store the voltage level of the first electrode, applies a first predetermined voltage to the second electrode to increase the voltage level of the first electrode by the first predetermined voltage, and discharges the first electrode so that the first electrode has a negative voltage level with respect to the second electrode.

9 Claims, 10 Drawing Sheets

(56) References Cited

U.S. PATENT DOCUMENTS

| | | | | |
|---|---|---|---|---|
| 2003/0016201 | A1 | 1/2003 | Edwards et al. | |
| 2004/0189578 | A1* | 9/2004 | Lin et al. | 345/98 |
| 2005/0174313 | A1* | 8/2005 | Kawachi | 345/98 |
| 2005/0190133 | A1* | 9/2005 | Kawachi | 345/87 |
| 2006/0181495 | A1* | 8/2006 | Edward | 345/92 |
| 2007/0040785 | A1* | 2/2007 | Edwards et al. | 345/92 |
| 2007/0229447 | A1* | 10/2007 | Takahara et al. | 345/102 |
| 2009/0303265 | A1* | 12/2009 | Kanou | 345/690 |
| 2012/0154369 | A1* | 6/2012 | Yamauchi | 345/212 |
| 2012/0169580 | A1* | 7/2012 | Nishi et al. | 345/98 |
| 2012/0169753 | A1* | 7/2012 | Murakami et al. | 345/560 |
| 2012/0256816 | A1* | 10/2012 | Yokota et al. | 345/87 |

FOREIGN PATENT DOCUMENTS

| | | |
|---|---|---|
| TW | 589503 | 6/2004 |
| TW | 200501038 | 1/2005 |
| WO | WO 2004/090854 | 10/2004 |

OTHER PUBLICATIONS

Taiwanese language office action dated Dec. 19, 2013.

English language translation of abstract of TW 516243 (published Jan. 1, 2003).

English language translation of abstract of TW 589503 (published Jun. 1, 2004).

* cited by examiner

DISPLAY DEVICE USING PIXEL MEMORY CIRCUIT TO REDUCE FLICKER WITH REDUCED POWER CONSUMPTION

CROSS REFERENCE TO RELATED APPLICATIONS

This Application claims priority of Japanese Patent Application No. 2010-238669, filed on Oct. 25, 2010, the entirety of which is incorporated by reference herein.

BACKGROUND OF THE INVENTION

1. Field of the Invention

The present invention relates to a display device wherein a memory circuit is installed in each pixel, and an electronic device using the same.

2. Description of the Related Art

For a conventional display device having a plurality of pixels arranged in a matrix formed by rows and columns, when an image is displayed, data is written to the pixels by a driver under an image display mode or dynamic image display mode. Especially, when a static image is displayed, the same data is continuously written to the pixels. Therefore, a technique is provided, wherein a memory is installed in each pixel so that when a static image is displayed, the data stored in the memory is written to the pixel. In this regard, driving of the driver can be stopped to reduce power consumption. This technique is usually called an MIP (Memory in Pixel) technique.

Generally, in the MIP technique, a memory circuit for storing data is adopted with a DRAM (Dynamic Random Access Memory) or an SRAM (Static Random Access Memory). The SRAM is constituted by a transistor sequential circuit. On the other hand, the DRAM is constituted by a transistor and a capacitor. Therefore, in view of minification of the circuit area and narrowing of the pixel gap, the DRAM is preferred. However, a DRAM needs a refresh operation to hold tiny electric charges stored in the capacitor. An example for a pixel circuit using DRAM is described in International publication no. 2004/090854(A1) pamphlet (Patent document 2).

Patent document 1: Japanese Patent Application Publication no. 2007-328351

Patent document 2: International publication no. 2004/090854(A1) pamphlet

However, in a normally black type liquid crystal display device, which displays black color when no voltage is applied to the liquid crystal cell, if a DRAM is used to construct the MIP circuit, flicker would occur while white color is displayed.

The invention provides a display device wherein a memory circuit is installed in each pixel but flicker does not occur, and an electronic device using the same.

BRIEF SUMMARY OF THE INVENTION

A detailed description is given in the following embodiments with reference to the accompanying drawings.

To achieve the above purpose, the invention provides a display device, comprising: a plurality of pixels arranged in a matrix, wherein each pixel has a first electrode, a second electrode, a light-transmitive element controlling the amount of transmissive light in response to a voltage difference between the first electrode and the second electrode, and a memory circuit storing the voltage level of the first electrode; and a controller refreshing the memory circuit periodically. In the case where the first electrode has a positive voltage level with respect to the second electrode at a refresh timing, the controller makes the memory circuit store the voltage level of the first electrode, applies a first predetermined voltage to the second electrode to increase the voltage level of the first electrode by the first predetermined voltage, and discharges the first electrode, so that the first electrode has a negative voltage level with respect to the second electrode.

In an embodiment, in the case where the first electrode has a negative voltage level with respect to the second electrode at a refresh timing, the controller makes the memory circuit store the voltage level of the first electrode, applies a second predetermined voltage which is lower than the first predetermined voltage to the second electrode and the first predetermined voltage to the first electrode to precharge the light-transmitive element, so that the first electrode has a positive voltage level with respect to the second electrode.

In an embodiment, the memory circuit has a DRAM.

In an embodiment, the display device further comprises: a plurality of source lines disposed respectively for each column of the plurality of pixels to apply data signals to the plurality of pixels; and a plurality of gate lines disposed respectively for each row of the plurality of pixels to apply control signals to the plurality of pixels to control the application of the data signals. Each pixel has a first switch element disposed between a corresponding source line and the first electrode, wherein the first switch element connects the first electrode to the corresponding source line in response to the control signal from a corresponding gate electrode line. The memory circuit of each pixel comprises: a capacitor storing the voltage level of the first electrode; a second switch element disposed between the first electrode and the capacitor, wherein the second switch element is controlled by the controller to connect the first electrode to the capacitor; a third switch element disposed between the first electrode and the corresponding source line, wherein the third switch element is controlled by the controller to connect the first electrode to the corresponding source line to discharge the first electrode; and a fourth switch element disposed between the first electrode and the third electrode, wherein the fourth switch element has a control terminal connected to a node between the capacitor and the second switch element, and the fourth switch element is conducted in response to a voltage difference between the corresponding source line, which is connected to the fourth switch element via the third switch element, and the control terminal.

In a modification of the display device, the first switch is not located between the corresponding source line and the first electrode. The first switch is included in the memory circuit of each pixel and arranged parallel with the fourth switch element. In this case, the third switch element is controlled by the controller to connect the first electrode to the corresponding source line via the first switch element, so that the voltage on the corresponding source line is applied to the first electrode.

In another modification of the display device, the parallel arrangement of the first switch element and the fourth switch element is substituted for the third switch element to be directly connected to the source line. Specifically, the fourth switch element is disposed between the third electrode and the corresponding source line and has a control terminal connected to a node between the capacitor and the second switch element, and the fourth switch element is conducted in response to a voltage difference between the corresponding source line and the control terminal to connect the third switch element to the corresponding source line.

In an embodiment, the first, second, third, and fourth switch elements are thin film transistors.

In an embodiment, the light-transmissive element is a liquid crystal cell and light is not allowed to pass through the liquid crystal cell when the voltage difference between the first electrode and the second electrode is zero.

In an embodiment, the display device can be embedded in an electronic device. The electronic device can be a battery-driven portable device which has limited power, such as a cell phone, a PDA, a portable player, or a portable game device, or a monitor showing an advertisement like a poster.

The invention provides a display device wherein a memory circuit is installed in each pixel but flicker does not occur, and an electronic device using the same

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
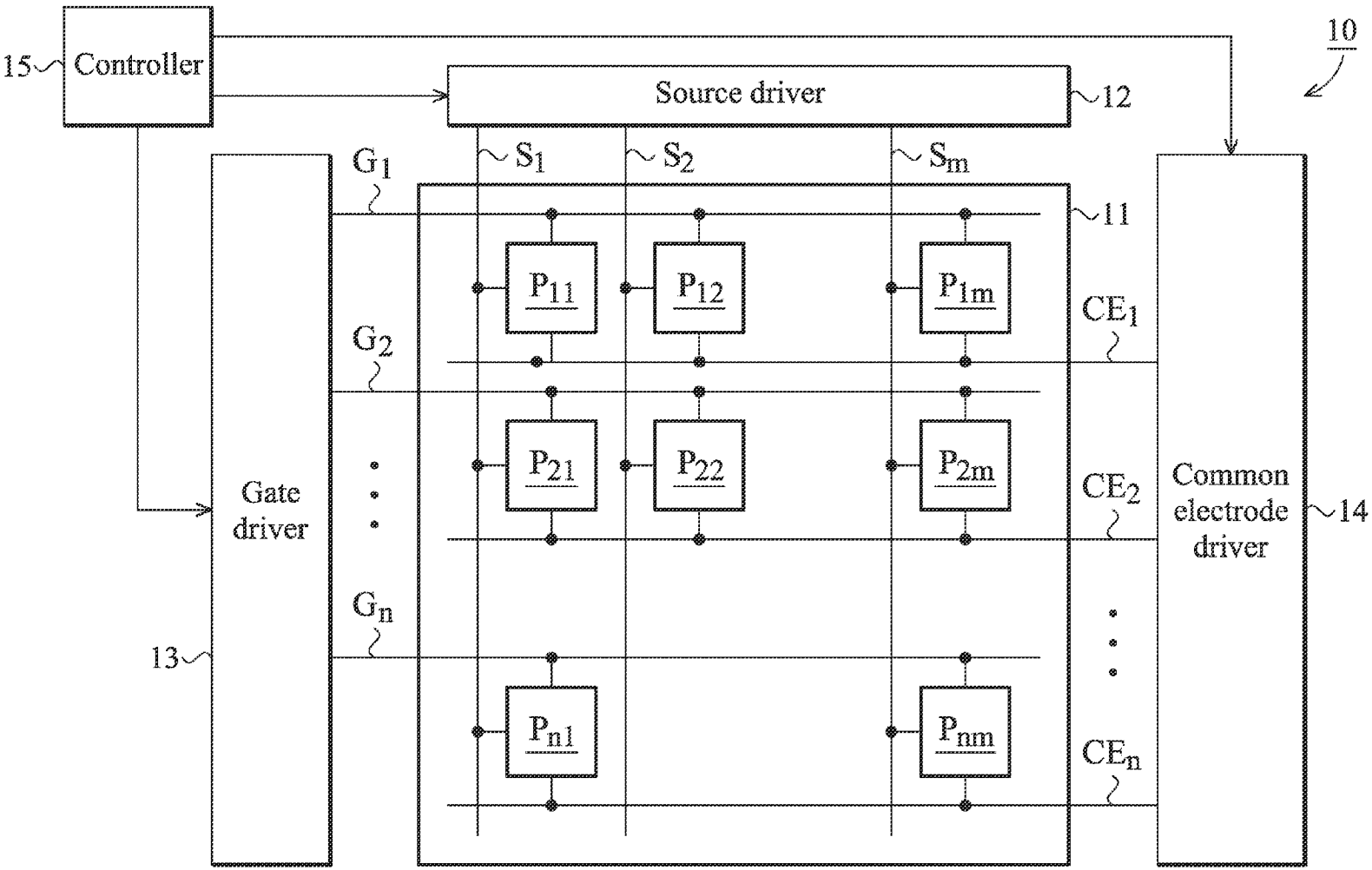
FIG. 1 is a block diagram of a display device in accordance with an embodiment of the invention.

FIG. 1 is a block diagram of a display device in accordance with an embodiment of the invention. In FIG. 1, a display device 10 comprises a display panel 11, a source driver 12, a gate driver 13, a common electrode driver 14, and a controller 15.

The display panel 11 comprises a plurality of pixels $P_{11}$~$P_{nm}$ (m and n are integers) arranged in a matrix formed by rows and columns. The display panel 11 further comprises a plurality of signal lines (also called source lines) S1, S2, . . . , and Sm arranged corresponding to the columns, and a plurality of scan lines (also called gate lines) G1, G2, . . . , and Gn arranged corresponding to the rows and orthogonal to the source lines S1, S2, . . . , and Sm.

The source driver 12 is a signal driving circuit which drives the source lines S1~Sm according to data signals. The source driver 12 applies signal voltages to the pixels $P_{11}$~$P_{nm}$ via the source lines S1~Sm. The gate driver 13 is a gate line driving circuit which drives the gate lines in sequence. The gate driver 13 controls signal voltage applications for the pixels $P_{11}$~$P_{nm}$ via the gate lines 17-1~**17-*n*. Specifically, the gate driver 13 drives pixel rows with an interlaced scan or progressive scan procedure so that the pixels on that pixel row are applied with signal voltages through the source lines. The common electrode driver 14 is a common electrode driving circuit which reverses a bias voltage applied to a common electrode of all pixels $P_{11}$~$P_{nm}$ every frame via common electrode lines CE1, CE2, . . . , and CEn. The controller 15 synchronizes the source driver 12, the gate driver 13, and the common driver 14** together, and controls the above devices.

Each of the pixels $P_{11}$~$P_{nm}$ comprises a light-transmissive element sandwiched between the pixel electrode and the common electrode. The light-transmissive element could be a liquid crystal cell which varies the amount of transmissive light in response to the voltage of two ends of the liquid crystal cell. The signal voltages are applied to the pixel electrodes in response to the scan signal, such that, a voltage difference is generated between the two ends of the liquid crystal cell (a two-end voltage of the liquid crystal cell is called in the following). The alignment of liquid crystal molecules is changed as a two-end voltage of the liquid crystal cell changes, so that the amount of transmissive light or reflective light can be varied by the liquid crystal cell. The pixels $P_{11}$~$P_{nm}$ can utilize the characteristic of the light-transmissive element to perform displaying. Each of the pixels $P_{11}$~$P_{nm}$ further comprises a memory circuit which stores a signal voltage applied to the pixel electrode. Under the static image displaying mode, each of the pixels $P_{11}$~$P_{nm}$ performs displaying according to the voltage stored in an embedded memory rather than signal voltage applied by the source lines S1~Sm. Therefore, under the static image displaying mode, the source driver 12 can be stopped. On the other hand, the display panel 11 still displays a static image.

Figure 2:
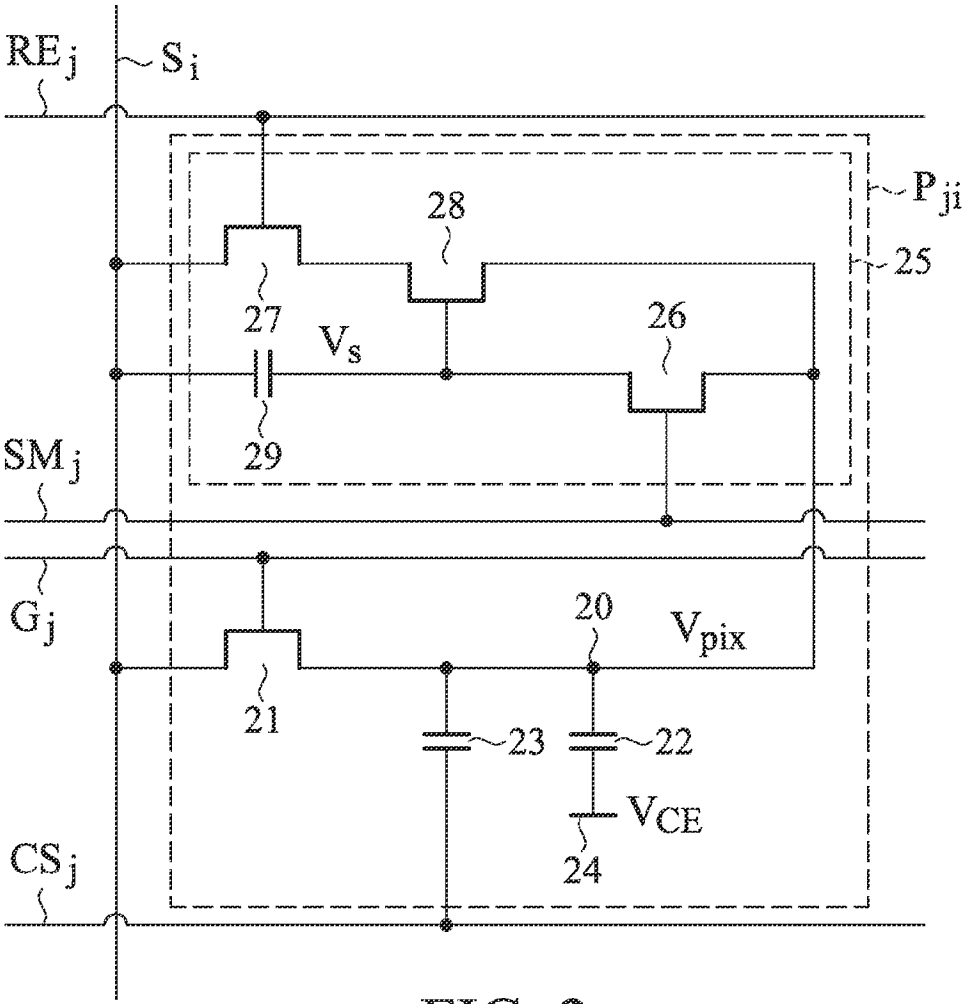
FIG. 2 is a circuitry diagram of a pixel in the display device in accordance with an embodiment of the invention.

FIG. 2 is a circuitry diagram of a pixel in the display device in accordance with an embodiment of the invention.

The pixel $P_{ji}$ (i and j are integers, wherein $1 \le i \le m$ and $1 \le j \le n$) is arranged at the cross region of the i-th source line Si and the j-th gate line Gj. Furthermore, a capacity storage line CSj is arranged for a pixel row in a manner parallel to the gate line Gj.

The pixel $P_{ji}$ comprises a pixel electrode 20, a first switch element 21, a liquid crystal cell 22, a charge storage capacitor 23, and a common electrode 24. Briefly, the liquid crystal cell 22 is represented by a capacitor connected between the pixel electrode 20 and the common electrode 24 in FIG. 2. The common electrode 24 is a common electrode for all pixels $P_{11}$~$P_{nm}$, which is connected to the common electrode driver 14 via the common electrode line CEj.

The first switch element 21 is disposed between the pixel electrode 20 and the source line Si. The control terminal of the first switch element 21 is connected to the gate line Gj. The first switch element 21 is conducted in response to the scan signal from the scan line Gj, and the pixel electrode 20 is connected to the source line Si. Thus, the pixel electrode 20 is applied with a signal voltage from the source line Si. Generally, a thin film transistor (TFT) is adopted as the first switch element 21. In the embodiment, the first switch element 21 is represented by an N-type TFT, which is conducted when the scan signal is at a high level.

The charge storage capacitor 23 is disposed between the pixel electrode 20 and the capacity storage line CSj. The charge storage capacitor 23 holds the voltage difference between the pixel electrode 20 and the common electrode 24 during the period from the beginning of the non-conductive state (OFF) of the switch element 21 through the beginning of the next conductive state (ON) of the switch element 21. In some case, the charge storage capacitor 23 could be connected to the common electrode 24 rather than the capacity storage line CSj.

In addition to the pixel electrode 20, the first switch element 21, the liquid crystal cell 22, the charge storage capacitor 23, and the common electrode 24, the pixel $P_{ji}$ further comprises a memory circuit 25. The memory circuit 25 comprises second, third, and fourth switch elements 26~28, and a sampling capacitor 29. The second, third, and fourth switch elements 26~28 can be TFTs. In the embodiments the second, third, and fourth switch elements 26~28 are represented by N-type TFTs. A terminal of the sampling capacitor 29 is connected to the source line Si and the other terminal of the sampling capacitor 29 is connected to the pixel electrode 20 via the second switch element 26.

Furthermore, a sampling line SMj and a refresh line REj traverse the pixel $P_{j1}$. A sampling line and a refresh line are disposed for a pixel row or column. In the embodiment, because pixels are selected with a unit of a row, the sampling line and the refresh line are disposed for each pixel row.

The control terminal of the second switch element 26 is connected to the sampling line SMj. The third switch element 27 and the fourth switch element 28 are connected in series between the pixel electrode 20 and the source line Si. The control terminal of the third switch element 27 is connected to the refresh line REj. The control terminal of the fourth switch element 28 is connected to a point between the sampling capacitor 29 and the second switch element 26. The sampling capacitor 29, the second, and the fourth switch elements 26, and 28 form a DRAM.

Following, the assumption of the liquid crystal display device of an embodiment of the invention is that the liquid crystal display device has the pixel circuit shown in FIG. 2, and the liquid crystal display device is a normally black type liquid crystal display device which displays a black image when no voltages are applied to the pixel electrodes. A reverse driving operation under a white displaying state is described as follows.

Figure 3:
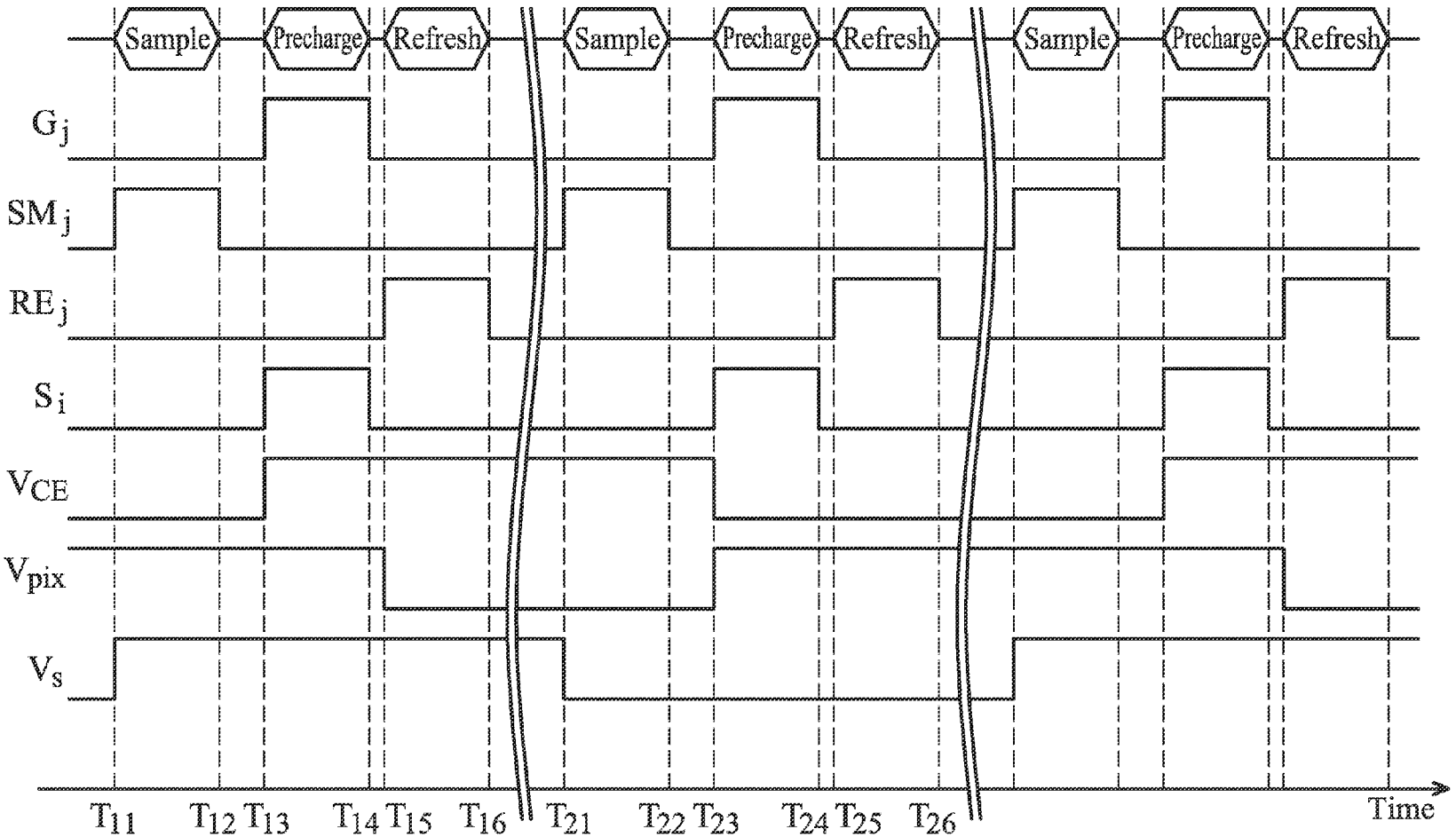
FIG. 3 (PRIOR ART)
FIG. 3 is a timing chart for driving the pixel circuit shown in FIG. 2 in accordance with the conventional driving scheme.

FIG. 3 is a timing chart for driving the pixel circuit shown in FIG. 2 in accordance with the conventional driving scheme.

Under an initial state (~$T_{11}$), the voltage level (called "pixel voltage" in the following) $V_{pix}$ of the pixel electrode 20 is at a high voltage level (for example, 5V), and the voltage level (called "common voltage" in the following) $V_{CE}$ of the common electrode 24 (and the capacity storage line CSj) is at a low voltage level (for example, 0V). Therefore, the two-end voltage of the liquid crystal cell 22 is +5V. Meanwhile, the first, second, third, and fourth switch elements 21, 26~28 are turned off.

At timing $T_{11}$, to sample the present pixel voltage $V_{pix}$, the voltage level on the sampling line SMj is raised to a high voltage level by the controller 15 and the second switch element 26 is turned on. Therefore, the voltage level (called "sampling voltage" in the following) $V_S$ between the second switch element 26 and the sampling capacitor 29 becomes a voltage level equivalent to a high voltage level. Although the voltage level on the sampling line SMj is pulled down to a low voltage level later at the timing $T_{12}$, the sampling voltage $V_S$ is still maintained at a high voltage level because of the effect of the capacitor 29.

During the period $T_{13}$~$T_{14}$, to precharge the display element 22 and the charge storage capacitor 23, the voltage level on the gate line Gj is raised to a high voltage level by the gate driver 13. Meanwhile, the voltage level on the source line Si is raised to a high voltage level by the source driver 12. Thus, the first switch element 21 is turned on and the pixel electrode 20 is connected to the source line Si. At the beginning of the precharge period $T_{13}$, the common voltage $V_{CE}$ is raised to a high voltage level by the common electrode driver 14.

At the end of the precharge period $T_{14}$, the voltage level on the gate line Gj is pulled down to a low voltage level by the gate driver 13 and the first switch element 21 is turned off. Following, the voltage level on the source line Si is pulled down to a low voltage level by the source driver 12 and the common voltage $V_{CE}$ is maintained at a high voltage level.

Next, at timing $T_{15}$, the voltage level on the refresh line REj is raised to a high voltage level by the controller 15 and the third switch element 27 is turned on. The conductive terminal (source) of the fourth switch element 28 is connected to the source line Si via the third switch element 27, such that the voltage level at the conductive terminal of the fourth switch element 28 becomes a low voltage level. At this time, the sampling voltage $V_S$ at the control terminal of the fourth switch element 28 is at a high voltage level such that the fourth switch element 28 is turned on. Accordingly, the pixel electrode 20 is connected to the source line Si via the third switch element 27 and the fourth switch element 28, and the pixel voltage $V_{pix}$ is at a low voltage level. At timing $T_{16}$, the voltage level on the refresh line REj is pulled down to a low voltage level and the third switch element 27 is turned off.

Finally, the pixel voltage $V_{pix}$ and the common voltage $V_{CE}$ are reversed with respect to the initial states; namely, a high voltage level is changed to a low voltage level, and vice versa. Therefore, the two-end voltage of the liquid crystal cell 22 is −5V, wherein the polarity has been reversed.

Under this state, at the next sampling timing $T_{21}$, to sample the present pixel voltage $V_{pix}$, the voltage level on the sampling line SMj is raised to high by the controller 15 and the second switch element 26 is turned on. Therefore, the sampling voltage $V_S$ becomes a voltage level equivalent to a low voltage level. After that, at timing $T_{22}$, the voltage level on the sampling line SMj is pulled down to a low voltage level.

During the period $T_{23}$~$T_{24}$, to precharge the liquid crystal cell 22 and the charge storage capacitor 23, the voltage level on the gate line Gj is raised to a high voltage level by the gate driver 13. Meanwhile, the voltage level on the source line Si is raised to a high voltage level by the source driver 12. Thus, the first switch element 21 is turned on and the pixel electrode 20 is connected to the source line Si. Therefore, the pixel voltage $V_{pix}$ is raised to a high voltage level. At the beginning of the precharge period $T_{23}$, the common voltage $V_{CE}$ is pulled down to a low voltage level by the common driver 14.

At the end of the precharge period $T_{24}$, the voltage level on the gate line Gj is pulled down to a low voltage level by the gate driver 13 and the first switch element 21 is turned off. Following, the voltage level on the source line Si is pulled down to a low voltage level by the source driver 12.

Next, at timing $T_{25}$, the voltage level on the refresh line REj is raised to a high voltage level by the controller 15 and the third switch element 28 is turned on. The conductive terminal (source) of the fourth switch element 28 is connected to the source line Si via the third switch element 27, such that the voltage level at the conductive terminal of the fourth switch element 28 becomes a low voltage level. However, at this time, the sampling voltage $V_S$ at the control terminal of the fourth switch element 28 is at a low voltage level such that the fourth switch element 28 is still turned off. Because the fourth switch element 28 is turned off, the pixel electrode 20 is not connected to the source line Si, and the pixel voltage $V_{pix}$ is maintained at a high voltage level. At timing $T_{26}$, the voltage level on the refresh line REj is pulled down to a low voltage level and the third switch element 27 is turned off.

Finally, the pixel voltage $V_{pix}$ and the common voltage $V_{CE}$ are reversed again, wherein a high voltage level is changed to a low voltage level, and vice versa. The pixel voltage $V_{pix}$ and the common voltage $V_{CE}$ return back to the initial states. Therefore, the two-end voltage of the liquid crystal cell 22 is +5V, wherein the polarity has been reversed again.

However, according to the conventional driving scheme, in the operation where the polarity of the two-end voltage of the liquid crystal cell 22 changes from + to −, a period where the two-end voltage of the liquid crystal cell 22 is zero exists (from the beginning of the precharge period $T_{13}$ to the beginning of the refresh period $T_{15}$). Therefore, the pixel to display white color displays black color in this period. Suppose that the duration of the period where the two-end voltage of the liquid crystal cell 22 is zero is 100 μsec in the operation where the polarity of the two-end voltage of the liquid crystal cell 22 changes from + to −, though the duration is extremely short, a flicker can still be identified by human eyes during this period. In this case, shortening the refresh period is a way to solve this problem, but power consumption is raised, so adopting the MIP circuit in the pixel loses its purpose.

Figure 4:
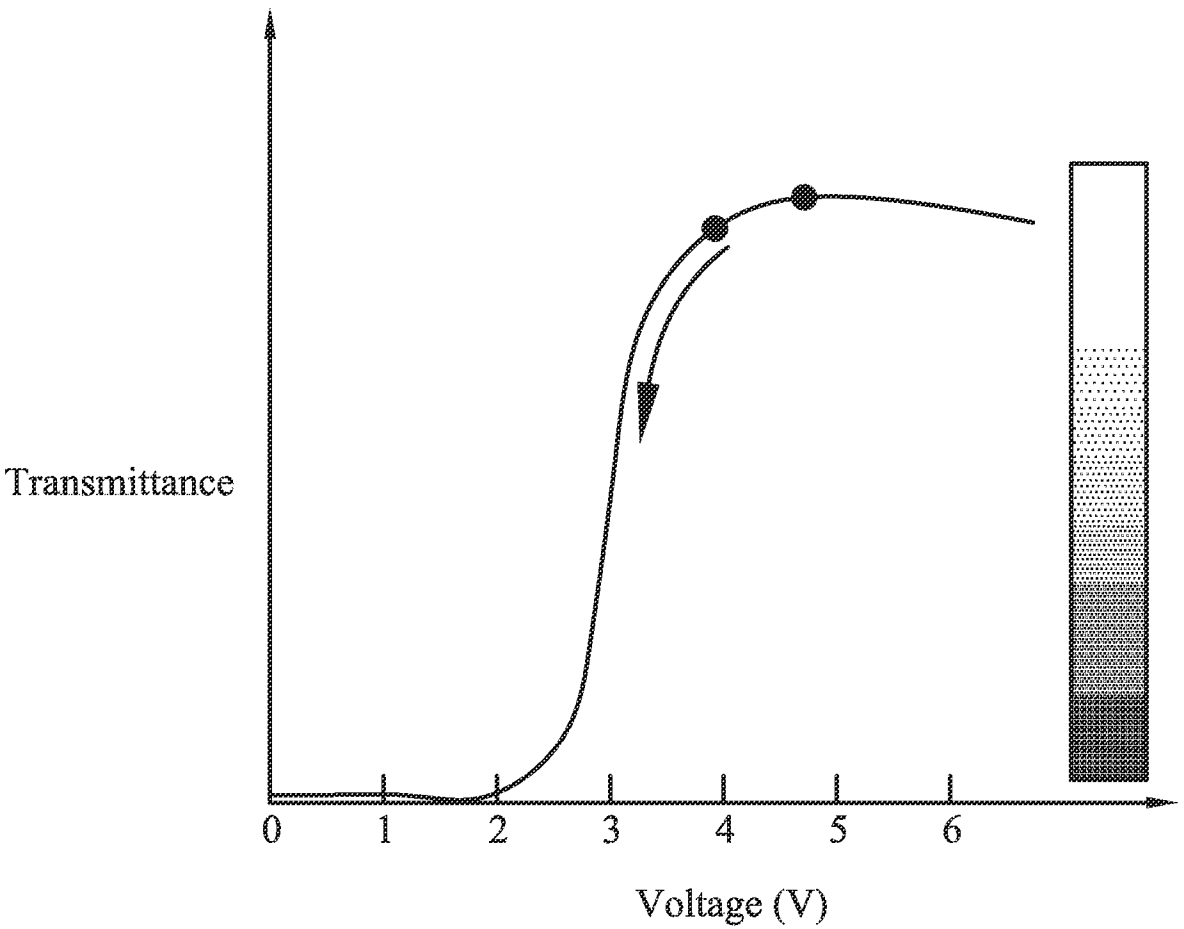
FIG. 4 shows a relationship between two-end voltage difference and transmittance of a normal black liquid crystal cell.

FIG. 4 shows a relationship between two-end voltage difference and transmittance of a normal black liquid crystal cell. In FIG. 4, the horizontal axis represents voltage and the vertical axis represents transmittance. According to the type of the display device, the vertical axis can represent reflectance to replace transmittance.

In FIG. 4, the curve shows that transmittance within a low voltage range 0~2V is flatter than within a high range 4~5V. This means that as voltage changes, flicker is generated under the white state more easily than under the black state. As shown by the arrow in FIG. 4, the response speed of transmittance at a high voltage range is faster than at a low voltage range. Therefore, flicker under the white state is more serious than under the black state.

Figure 5:
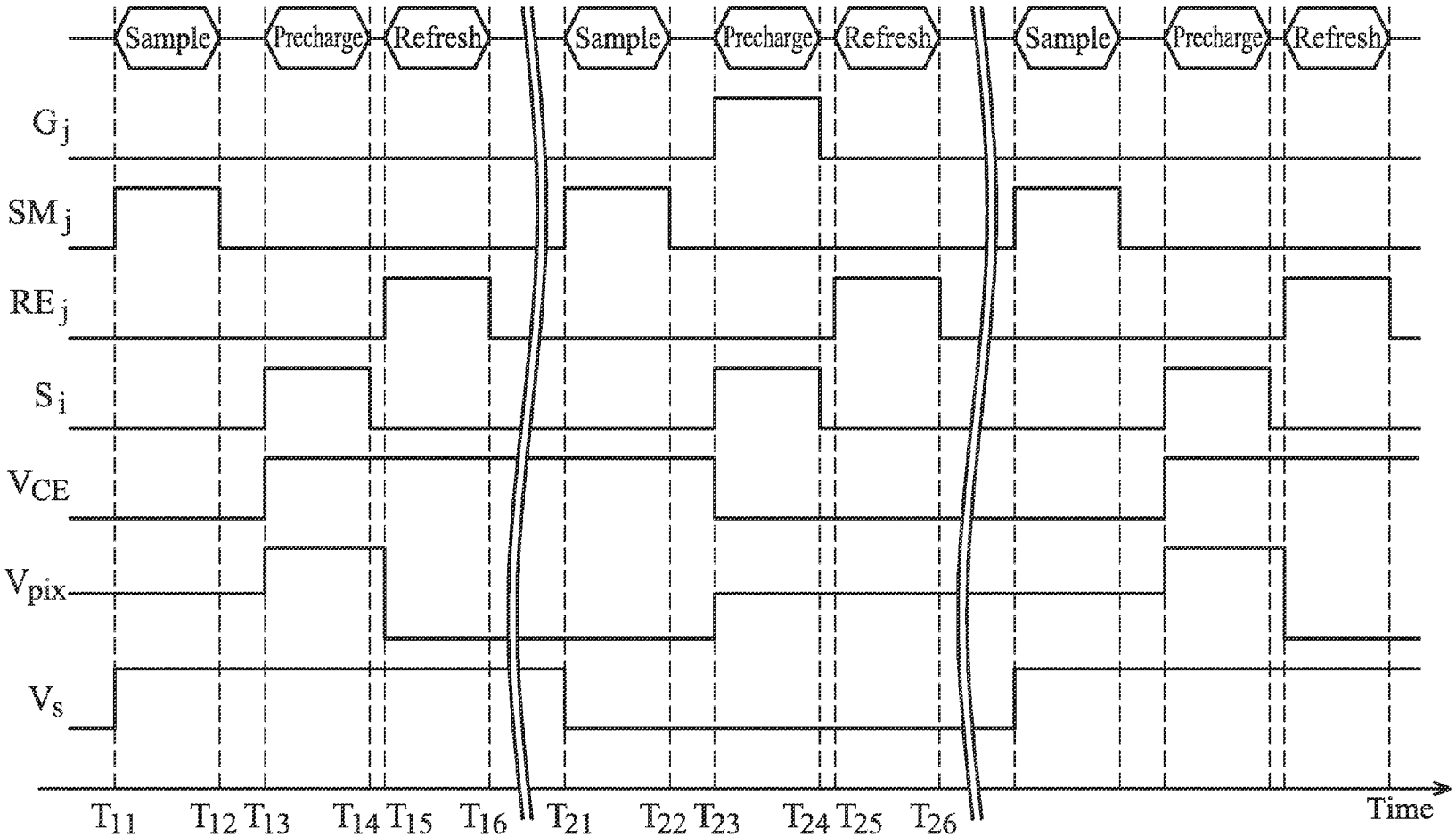
FIG. 5 is a timing chart for driving the pixel circuit shown in FIG. 2 in accordance with the driving scheme of an embodiment of the invention.

FIG. 5 is a timing chart for driving the pixel circuit shown in FIG. 2 in accordance with the driving scheme of an embodiment of the invention.

Under an initial state (~$T_{11}$), the pixel voltage $V_{pix}$ is at a high voltage level, and the common voltage $V_{CE}$ is at a low voltage level. Therefore, the two-end voltage of the liquid crystal cell 22 is +5V. Meanwhile, the first, second, third, and fourth switch elements 21, 26~28 are turned off.

At timing $T_{11}$, to sample the present pixel voltage $V_{pix}$, the voltage level on the sampling line SMj is raised to a high voltage level by the controller 15 and the second switch element 26 is turned on. Therefore, the sampling voltage $V_S$ existing between the second switch element 26 and the sampling capacitor 29 becomes a voltage level equivalent to a high voltage level. Although the voltage level on the sampling line SMj is pulled down to a low voltage level later at the timing $T_{12}$, the sampling voltage $V_S$ is still maintained at a high voltage level because of the effect of the capacitor 29.

During the period $T_{13}$~$T_{14}$, the voltage level on the source line Si is raised to a high voltage level by the source driver 12 and the common voltage $V_{CE}$ is raised to a high voltage level by the common driver 14. Thus, because of capacitive coupling voltage multiplication, the pixel voltage $V_{pix}$ of the pixel electrode 20 is increased by the amount of the common voltage $V_{CE}$ applied to the common electrode 24, such that pixel voltage $V_{pix}$ becomes +10V. Therefore, the two-end voltage of the liquid crystal cell never becomes 0V which can be seen in the conventional driving scheme. The two-end voltage of the liquid crystal cell is maintained at $V_{pix}-V_{CE}=(+10V)-(+5V)=+5V$.

At the end of the precharge period $T_{14}$, the voltage level on the source line Si is pulled down to a low voltage level by the source driver 12 and the common voltage $V_{CE}$ is maintained at a high voltage level.

Next, at timing $T_{15}$, the voltage level on the refresh line REj is raised to a high voltage level by the controller 15 and the third switch element 27 is turned on. The conductive terminal (source) of the fourth switch element 28 is connected to the source line Si via the third switch element 27, such that the voltage level at the conductive terminal of the fourth switch element 28 becomes a low voltage level. At this time, the sampling voltage $V_S$ at the control terminal of the fourth switch element 28 is at a high voltage level such that the fourth switch element 28 is turned on. Accordingly, the pixel electrode 20 is connected to the source line Si via the third switch element 27 and the fourth switch element 28, and the pixel voltage $V_{pix}$ is at a low voltage level. At timing $T_{16}$, the voltage level on the refresh line REj is pulled down to a low voltage level and the third switch element 27 is turned off.

Finally, the pixel voltage $V_{pix}$ and the common voltage $V_{CE}$ are reversed with respect to the initial states. Namely, a high voltage level is changed to a low voltage level, and vice versa. Therefore, the two-end voltage of the liquid crystal cell 22 is −5V, wherein the polarity has been reversed.

The operation where the polarity of the two-end voltage of the liquid crystal cell 22 changes from − to + is the same as the conventional driving scheme described in FIG. 3, such that the details are not described again.

According to the driving scheme shown in FIG. 5, in the operation where the polarity of the two-end voltage of the liquid crystal cell 22 changes from + to − under the white state, the gate line is not driven to a high voltage level during the period corresponding to the original precharge period. Thus, the two-end voltage of the liquid crystal cell is prevented from becoming 0V. In other words, flicker can be prevented by omitting the precharge period. Therefore, in the case where the pixel electrode 20 has a positive potential with respect to the common electrode 24 at the refresh timing of the memory circuit 25, the controller 15 controls the memory circuit to store the potential of the pixel electrode 20. Then a predetermined voltage (=high) is applied to the common electrode 24 such that the potential of the pixel electrode 20 is increased by the amount of the predetermined voltage. Finally, the pixel electrode 20 is discharged such that the pixel electrode 20 has a negative potential with respect to the common electrode 24. This driving scheme doesn't need to shorten the refresh period, change circuits, or add circuits. Thus, the driving scheme has more advantages for power consumption and circuit scale.

Figure 6:
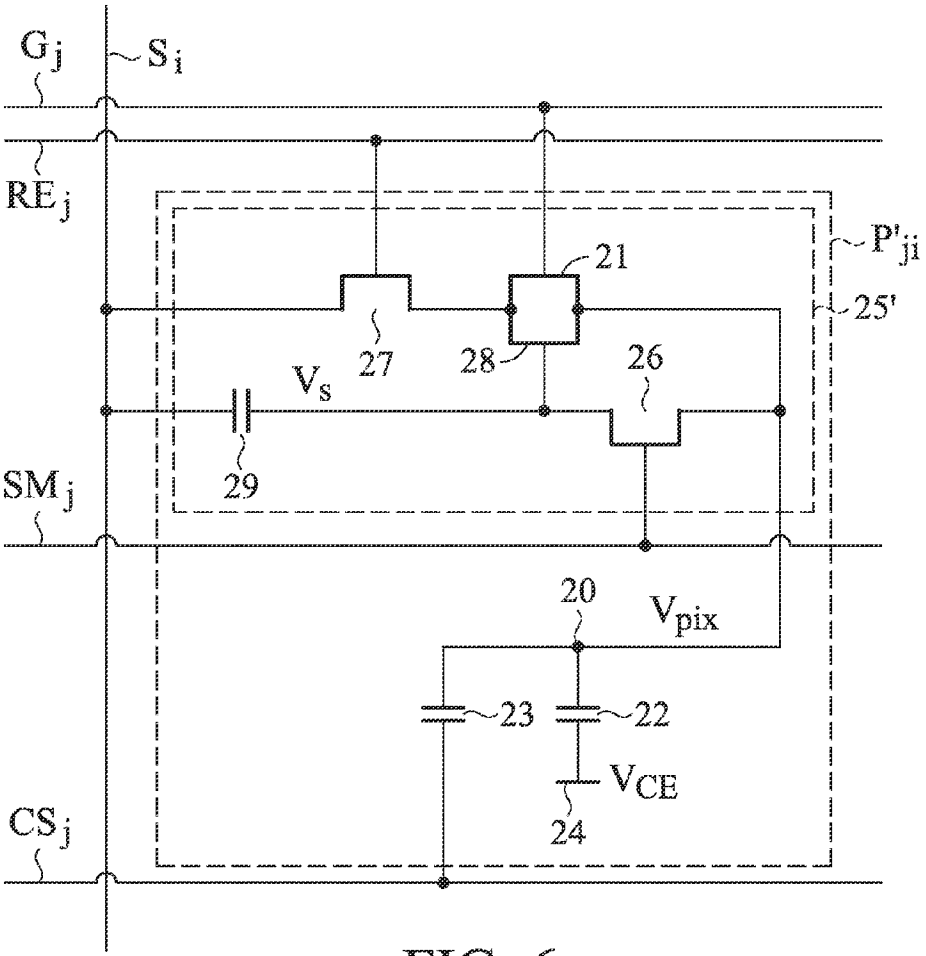
FIG. 6 is another circuitry diagram of a pixel in the display device in accordance with an embodiment of the invention.

FIG. 6 is another circuitry diagram of a pixel in the display device in accordance with an embodiment of the invention. In this circuit, the first switch element 21 is not located between the pixel electrode 20 and the source line Si, but included in the memory circuit 25'. The first switch element 21 is disposed parallel with the fourth switch element 28. Therefore, only the third switch element 27 is directly connected to the source line Si. In comparison with the circuit shown in FIG. 2, this circuit has the source line Si with small capacitance, and less leak current paths.

Following, assume that a liquid crystal display device is a normally black type liquid crystal display device. Accordingly, a reverse driving operation of the pixel circuit shown in FIG. 6 under a white displaying state is described.

Figure 7:
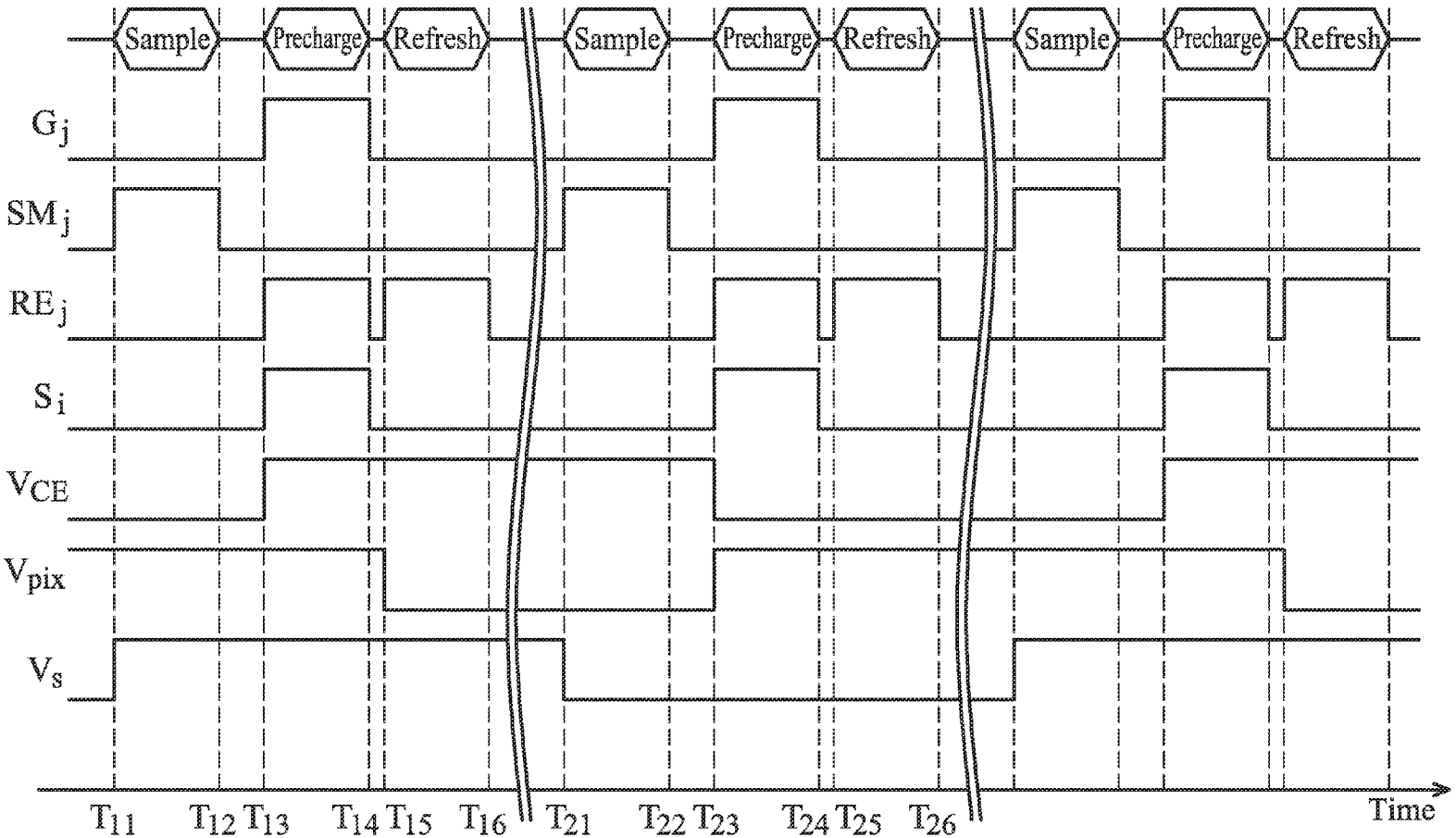
FIG. 7 (PRIOR ART)
FIG. 7 is a timing chart for driving the pixel circuit shown in FIG. 6 in accordance with the conventional driving scheme.

FIG. 7 is a timing chart for driving the pixel circuit shown in FIG. 6 in accordance with the conventional driving scheme.

Under an initial state (~$T_{11}$), the pixel voltage $V_{pix}$ is at a high voltage level, and the common voltage $V_{CE}$ is at a low voltage level. Therefore, the two-end voltage of the liquid crystal cell 22 is +5V. Meanwhile, the first, second, third, and fourth switch elements 21, 26~28 are turned off.

At timing $T_{11}$, to sample the present pixel voltage $V_{pix}$, the voltage level on the sampling line SMj is raised to a high voltage level by the controller 15 and the second switch element 26 is turned on. Therefore, the sampling voltage $V_S$ between the second switch element 26 and the sampling capacitor 29 becomes a voltage level equivalent to a high voltage level. Although the voltage level on the sampling line SMj is pulled down to a low voltage level later at timing $T_{12}$, the sampling voltage $V_S$ is still maintained at a high voltage level because of the effect of the capacitor 29.

During the period $T_{13}$~$T_{14}$, to precharge the display element 22 and the charge storage capacitor 23, the voltage level on the gate line Gj is raised to a high voltage level by the gate driver 13, and the voltage level on the refresh line REj is raised to a high voltage level by the controller 15. Meanwhile, the voltage level on the source line Si is raised to a high voltage level by the source driver 12. Thus, the first switch element 21 and the third switch 27 are turned on, and the pixel electrode 20 is connected to the source line Si. At the beginning of the precharge period $T_{13}$, the common voltage $V_{CE}$ is raised to a high voltage level by the common driver 14.

At the end of the precharge period $T_{14}$, the voltage levels on the gate line Gj and the refresh line REj are pulled down to a low voltage level. The first switch element 21 and the third switch 27 are turned off. Following, the voltage level on the source line Si is pulled down to a low voltage level by the source driver 12 and the common voltage $V_{CE}$ is maintained at a high voltage level.

Next, at timing $T_{15}$, the voltage level on the refresh line REj is raised to a high voltage level again by the controller 15 and the third switch element 27 is turned on. The conductive terminal (source) of the fourth switch element 28 is connected to the source line Si via the third switch element 27, such that the voltage level at the conductive terminal of the fourth switch element 28 becomes a low voltage level. At this time, the sampling voltage $V_S$ at the control terminal of the fourth switch element 28 is at a high voltage level such that the fourth switch element 28 is turned on. Accordingly, the pixel electrode 20 is connected to the source line Si via the third switch element 27 and the fourth switch element 28, and the pixel voltage $V_{pix}$ is at a low voltage level. At timing $T_{16}$, the voltage level on the refresh line REj is pulled down to a low voltage level and the third switch element 27 is turned off.

Finally, the pixel voltage $V_{pix}$ and the common voltage $V_{CE}$ are reversed with respect to the initial states. Therefore, the voltage difference between two ends of the liquid crystal cell 22 is −5V, wherein the polarity has been reversed.

Under this state, at the next sampling timing $T_{21}$, to sample the present pixel voltage $V_{pix}$, the voltage level on the sampling line SMj is raised to a high voltage level by the controller 15 and the second switch element 26 is turned on. Therefore, the sampling voltage $V_S$ becomes a voltage level equivalent to a low voltage level. After that, at timing $T_{22}$, the voltage level on the sampling line SMj is pulled down to a low voltage level.

During the period $T_{23}$~$T_{24}$, to precharge the liquid crystal cell 22 and the charge storage capacitor 23, the voltage level on the gate line Gj is raised to a high voltage level by the gate driver 13, and the voltage level on the refresh line REj is raised to a high voltage level by the controller 15. Meanwhile, the voltage level on the source line Si is raised to a high voltage level by the source driver 12. Thus, the first switch element 21 and the third switch element 27 are turned on and the pixel electrode 20 is connected to the source line Si. Therefore, the pixel voltage $V_{pix}$ is raised to a high voltage level. At the beginning of the precharge period $T_{23}$, the common voltage $V_{CE}$ is pulled down to a low voltage level by the common electrode driver 14.

At the end of the precharge period $T_{24}$, the voltage levels on the gate line Gj and the refresh line REj are pulled down to a low voltage level. The first switch element 21 and the third switch element 27 are turned off. Following, the voltage level on the source line Si is pulled down to a low voltage level by the source driver 12.

Next, at timing $T_{25}$, the voltage level on the refresh line REj is raised to a high voltage level by the controller 15 and the third switch element 28 is turned on. The conductive terminal (source) of the fourth switch element 28 is connected to the source line Si via the third switch element 27, such that the voltage level at the conductive terminal of the fourth switch element 28 becomes a low voltage level. However, at this time, the sampling voltage $V_S$ at the control terminal of the fourth switch element 28 is at a low voltage level such that the fourth switch element 28 is still turned off. Because the fourth switch element 28 is turned off, the pixel electrode 20 is not connected to the source line Si, and the pixel voltage $V_{pix}$ is maintained at a high voltage level. At timing $T_{26}$, the voltage level on the refresh line REj is pulled down to a low voltage level and the third switch element 27 is turned off.

Finally, the pixel voltage $V_{pix}$ and the common voltage $V_{CE}$ are reversed again. The pixel voltage $V_{pix}$ and the common voltage $V_{CE}$ return back to the initial states. Therefore, the voltage difference between two ends of the liquid crystal cell 22 is +5V, wherein the polarity has been reversed again.

From FIG. 7, it is understood that even in the circuit of FIG. 6, a period where the two-end voltage of the liquid crystal cell becomes 0V (the period from the beginning of the precharge period $T_{13}$ to the beginning of the refresh period $T_{15}$) still exists in the operation where the polarity of the two-end voltage of the liquid crystal cell 22 changes from + to −. As a result, flicker is still generated, which can be identified by users.

Figure 8:
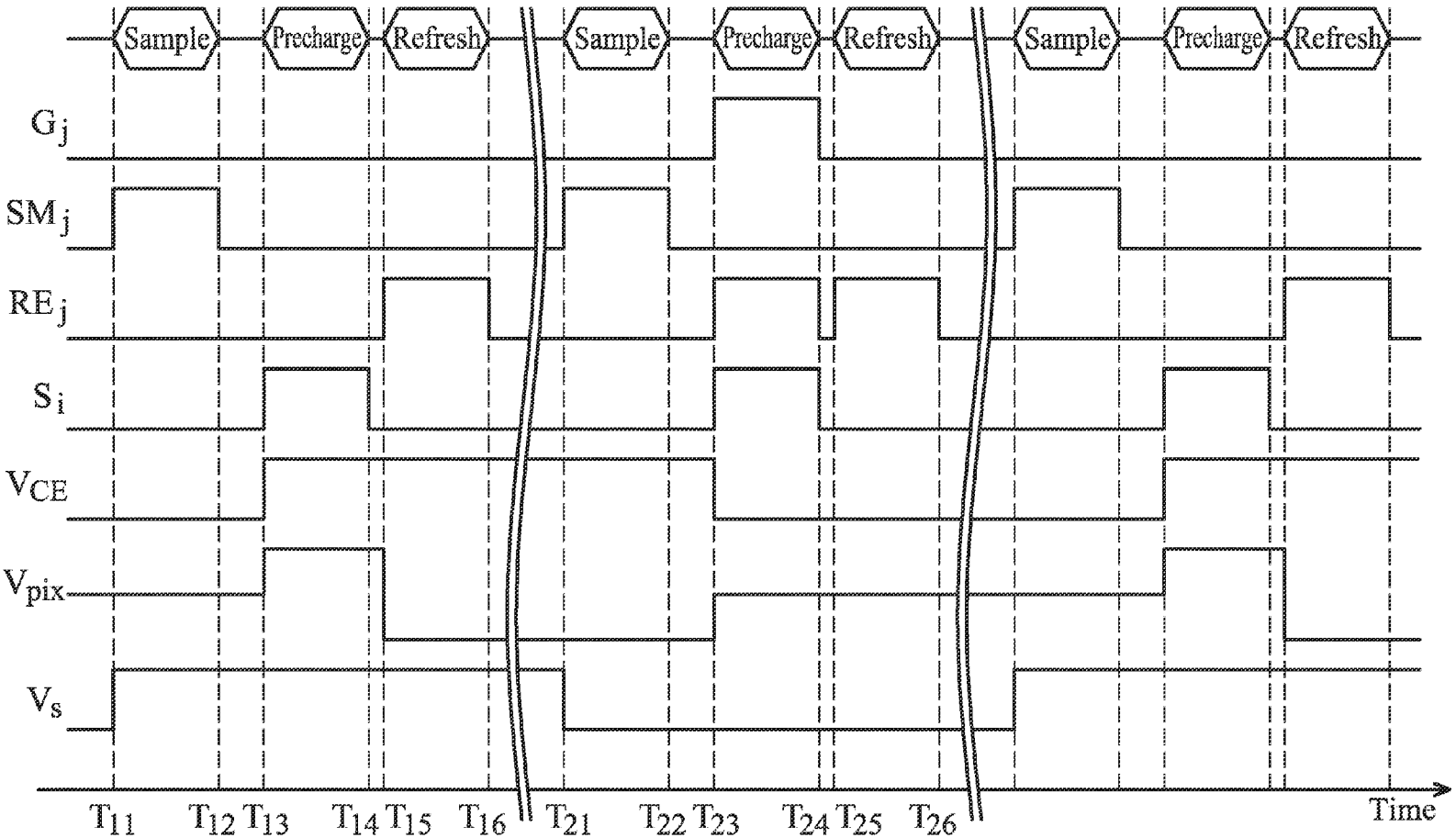
FIG. 8 is a timing chart for driving the pixel circuit shown in FIG. 6 in accordance with the driving scheme of an embodiment of the invention.

FIG. 8 is a timing chart for driving the pixel circuit shown in FIG. 6 in accordance with the driving scheme of an embodiment of the invention.

Under an initial state (~$T_{11}$), the pixel voltage $V_{pix}$ is at a high voltage level, and the common voltage $V_{CE}$ is at a low voltage level. Therefore, the two-end voltage of the liquid crystal cell 22 is +5V. Meanwhile, the first, second, third, and fourth switch elements 21, 26~28 are turned off.

At timing $T_{11}$, to sample the present pixel voltage $V_{pix}$, the voltage level on the sampling line SMj is raised to a high voltage level by the controller 15 and the second switch element 26 is turned on. Therefore, the sampling voltage $V_S$ existing between the second switch element 26 and the sampling capacitor 29 becomes a voltage level equivalent to a high voltage level. Although the voltage level on the sampling line SMj is pulled down to a low voltage level later at timing $T_{12}$, the sampling voltage $V_S$ is still maintained at a high voltage level because of the effect of the capacitor 29.

During the period $T_{13}$~$T_{14}$, the voltage level on the source line Si is raised to a high voltage level by the source driver 12 and the common voltage $V_{CE}$ is raised to a high voltage level by the common driver 14. Thus, because of voltage multiplication, the pixel voltage $V_{pix}$ of the pixel electrode 20 is increased by the amount of the common voltage $V_{CE}$ applied to the common electrode 24. The pixel voltage $V_{pix}$ becomes +10V. Therefore, the two-end voltage of the liquid crystal cell never becomes 0V which can be seen in the conventional driving scheme. The two-end voltage of the liquid crystal cell is maintained at $V_{pix}-V_{CE}=(+10V)-(+5V)=+5V$.

At the end of the precharge period $T_{14}$, the voltage level on the source line Si is pulled down to a low voltage level by the source driver 12 and the common voltage $V_{CE}$ is maintained at a high voltage level.

Next, at timing $T_{15}$, the voltage level on the refresh line REj is raised to a high voltage level by the controller 15 and the third switch element 27 is turned on. The conductive terminal (source) of the fourth switch element 28 is connected to the source line Si via the third switch element 27, such that the voltage level at the conductive terminal of the fourth switch element 28 becomes a low voltage level. At this time, the sampling voltage $V_S$ at the control terminal of the fourth switch element 28 is at a high voltage level such that the fourth switch element 28 is turned on. Accordingly, the pixel electrode 20 is connected to the source line Si via the third switch element 27 and the fourth switch element 28, and the pixel voltage $V_{pix}$ is at a low voltage level. At timing $T_{16}$, the voltage level on the refresh line REj is pulled down to a low voltage level and the third switch element 27 is turned off.

Finally, the pixel voltage $V_{pix}$ and the common voltage $V_{CE}$ are reversed with respect to the initial states. Therefore, the voltage difference between two ends of the liquid crystal cell 22 is −5V, wherein the polarity has been reversed.

The operation where the polarity of the voltage difference between two ends of the liquid crystal cell 22 changes from − to + is the same as the conventional driving scheme described in FIG. 3, such that the details are not described again.

According to the driving scheme shown in FIG. 8, in the operation where the polarity of the voltage difference between two ends of the liquid crystal cell 22 changes from + to − under the white state, the gate line and the refresh line are not driven to a high voltage level during the period corresponding to the original precharge period. Thus, the two-end voltage of the liquid crystal cell is prevented from becoming 0V. In other words, flicker can be prevented by omitting the precharge period.

Figure 9:
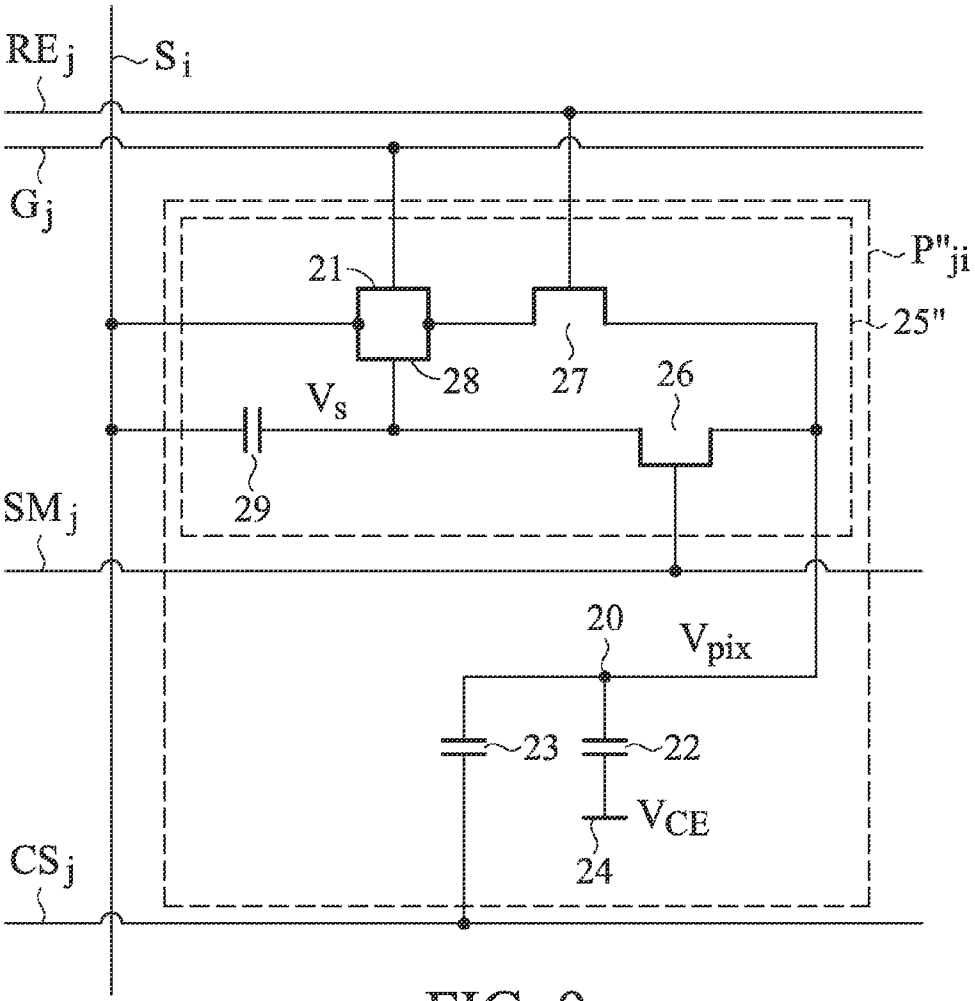
FIG. 9 is another circuitry diagram of a pixel in the display device in accordance with an embodiment of the invention.

FIG. 9 is another circuitry diagram of a pixel in the display device in accordance with an embodiment of the invention. This circuit is a modification of the circuit shown in FIG. 6. The parallel arrangement of the first switch element 21 and the fourth switch element 28 is substituted for the third switch element 27 to be directly connected to the source line Si.

In the case of a normally black type liquid crystal display device, whether the conventional driving scheme or the driving scheme of the invention is utilized, the timing chart of the reverse driving operation of the pixel circuit shown in FIG. 9 under the white displaying state is the same as the timing charts shown in FIGS. 7, and 8 for the circuit shown in FIG. 6. Therefore, details are not described again.

As described above, according to the driving scheme of the invention, in the operation where the polarity of the voltage difference between two ends of a light-transmissive element (for example, a liquid crystal cell) changes from + to − under the white state, a display device wherein a memory circuit is installed in each pixel does not flicker by omitting the precharge period.

Figure 10:
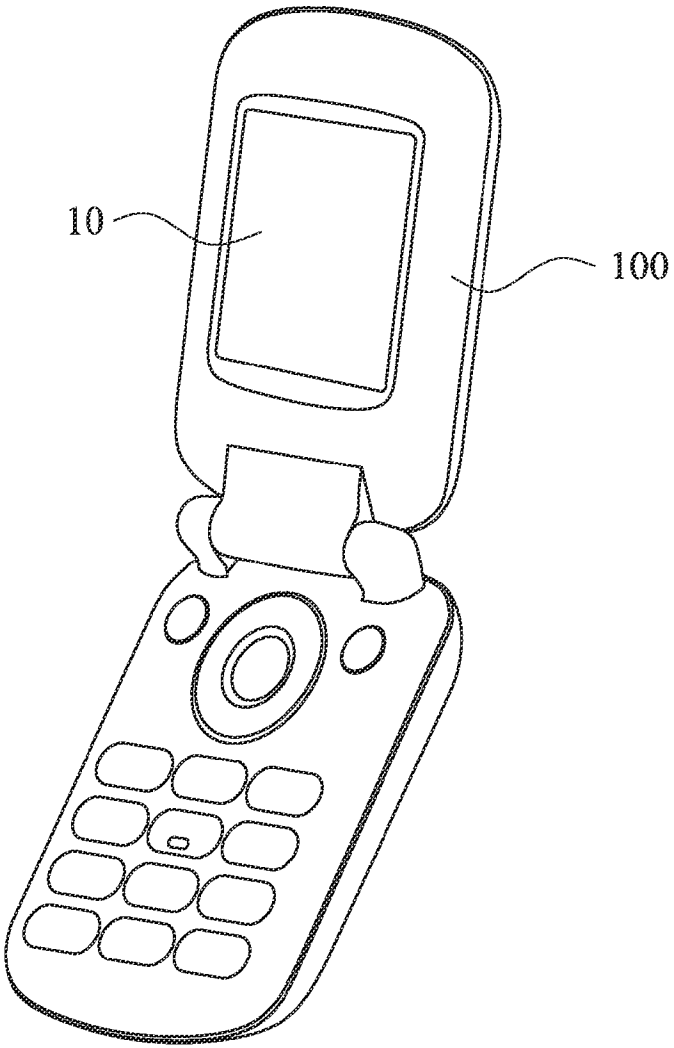
FIG. 10 is an example showing an electronic device provided with a display device in accordance with an embodiment of the invention.

FIG. 10 is an example showing an electronic device provided with a display device in accordance with an embodiment of the invention.

The electronic device 100 in FIG. 10 is represented by a cell phone, but other electronic devices such as a television, a laptop computer, a desktop computer, a tablet computer, a digital camera, a PDA, a car navigation device, a portable game device, an AURORA VISION, or etc. is also suitable for the invention. The electronic device 100 comprises a display device 10 provided with a display panel for displaying images.

The display device 10 has a pixel circuit (any one of pixel circuits shown in FIGS. 2, 6, and 9) operating according to the driving scheme of the embodiment of the invention. When a static image is displayed, the data stored in the memory is written to the pixel so that the driver can be stopped. Thus, the display device 10 is especially suitable for a battery-driven portable device which has limited power, such as a cell phone, a PDA, a portable player, or a portable game device, or for a monitor showing an advertisement like a poster.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a plurality of pixels arranged in a matrix, wherein each pixel has a first electrode, a second electrode, a light-transmittive element controlling the amount of transmissive light in response to a voltage difference between the first electrode and the second electrode, and a memory circuit storing the voltage level of the first electrode;

a controller refreshing the memory circuit periodically, a plurality of source lines disposed respectively for each column of the plurality of pixels to apply data signals to the plurality of pixels; and a plurality of gate lines disposed respectively for each row of the plurality of pixels to apply control signals to the plurality of pixels to control the application of the data signals, wherein each pixel has a first switch element disposed between a corresponding source line and the first electrode, wherein the first switch element connects the first electrode to the corresponding source line in response to the control signal from a corresponding gate electrode line, and wherein the memory circuit of each pixel comprises:

a capacitor storing the voltage level of the first electrode;

a second switch element disposed between the first electrode and the capacitor, wherein the second switch element is controlled by the controller to connect the first electrode to the capacitor;

a third switch element disposed between the first electrode and the corresponding source line, wherein the third switch element is controlled by the controller to connect the first electrode to the corresponding source line to discharge the first electrode; and a fourth switch element disposed between the first electrode and the third switch element, wherein the fourth switch element has a control terminal connected to a node between the capacitor and the second switch element, and the fourth switch element is conducted in response to a voltage difference between the corresponding source line, which is connected to the fourth switch element via the third switch element, and the control terminal wherein the second switch element is turned on so that the voltage level of the first electrode is stored in the capacitor in a sample period, then in the case where the first electrode has a positive voltage level with respect to the second electrode at a refresh timing, a first predetermined voltage is applied to the second electrode, under a state where the gate line turns off the first switch element, to increase the voltage level of the first electrode by the first predetermined voltage in a precharge period, and finally the third switch element is turned on to discharge the first electrode via the fourth switch element and the third switch element in the refresh period, so that the first electrode has a negative voltage level with respect to the second electrode.

2. The display device as claimed in claim 1, wherein in the case where the first electrode has a negative voltage level with respect to the second electrode at a refresh timing, a second predetermined voltage which is lower than the first predetermined voltage is applied to the second electrode and the gate line turns on the first switch to allow the first predetermined voltage being applied to the first electrode to precharge the light-transmitive element in the precharqe period, so that the first electrode has a positive voltage level with respect to the second electrode.

3. The display device as claimed in claim 1, wherein the memory circuit has a DRAM.

4. The display device as claimed in claim 1, wherein the first, second, third, and fourth switch elements are thin film transistors.

5. The display device as claimed in claim 1, wherein the light-transmissive element is a liquid crystal cell.

6. The display device as claimed in claim 5, wherein light is not allowed to pass through the liquid crystal cell when the voltage difference between the first electrode and the second electrode is zero.

7. An electronic device, comprising the display device as claimed in claim 1.

8. A display device, comprising:

a plurality of pixels arranged in a matrix, wherein each pixel has a first electrode, a second electrode, a light-transmittive element controlling the amount of transmissive light in response to a voltage difference between the first electrode and the second electrode, and a memory circuit storing the voltage level of the first electrode;

a controller refreshing the memory circuit periodically, a plurality of source lines disposed respectively for each column of the plurality of pixels to apply data signals to the plurality of pixels; and a plurality of gate lines disposed respectively for each row of the plurality of pixels to apply control signals to the plurality of pixels to control the application of the data signals, wherein the memory circuit of each pixel comprises:

a first switch element connecting the first electrode to a corresponding source line in response to the control signal from a corresponding gate line;

a capacitor storing the voltage level of the first electrode;

a second switch element disposed between the first electrode and the capacitor, wherein the second switch element is controlled by the controller to connect the first electrode to the capacitor;

a third switch element disposed between the first electrode and the corresponding source line, wherein the third switch element is controlled by the controller to connect the first electrode to the corresponding source line to discharge the first electrode; and a fourth switch element disposed between the first electrode and the third switch element, wherein the fourth switch element has a control terminal connected to a node between the capacitor and the second switch element, and the fourth switch element is conducted in response to a voltage difference between the corresponding source line, which is connected to the fourth switch element via the third switch element, and the control terminal, wherein the first switch element is arranged parallel with the fourth switch element, wherein the second switch element is turned on so that the voltage level of the first electrode is stored in the capacitor in a sample period, then in the case where the first electrode has a positive voltage level with respect to the second electrode at a refresh timing, a first predetermined voltage is applied to the second electrode, under a state where the gate line turns off the first switch element, to increase the voltage level of the first electrode by the first predetermined voltage in a precharge period, and finally the third switch element is turned on to discharge the first electrode via the fourth switch element and the third switch element in the refresh period, so that the first electrode has a negative voltage level with respect to the second electrode.

9. A display device, comprising:

a plurality of pixels arranged in a matrix, wherein each pixel has a first electrode, a second electrode, a light-transmittive element controlling the amount of transmissive light in response to a voltage difference between the first electrode and the second electrode, and a memory circuit storing the voltage level of the first electrode;

a controller refreshing the memory circuit periodically, a plurality of source lines disposed respectively for each column of the plurality of pixels to apply data signals to the plurality of pixels; and a plurality of gate lines disposed respectively for each row of the plurality of pixels to apply control signals to the plurality of pixels to control the application of the data signals, wherein the memory circuit of each pixel comprises:

a first switch element connecting the first electrode to a corresponding source line in response to the control signal from a corresponding gate line;

a capacitor storing the voltage level of the first electrode;

a second switch element disposed between the first electrode and the capacitor, wherein the second switch element is controlled by the controller to connect the first electrode to the capacitor;

a third switch element disposed between the first electrode and the first switch element, wherein the third switch element is controlled by the controller to connect the first electrode to the corresponding source line to discharge the first electrode; and a fourth switch element disposed between the third switch element and the corresponding source line, wherein the fourth switch element has a control terminal connected to a node between the capacitor and the second switch element, and the fourth switch element is conducted in response to a voltage difference between the corresponding source line and the control terminal to connect the third switch element to the corresponding source line, wherein the first switch element is arranged parallel with the fourth switch element, wherein the second switch element is turned on so that the voltage level of the first electrode is stored in the capacitor in a sample period, then in the case where the first electrode has a positive voltage level with respect to the second electrode at a refresh timing, a first predetermined voltage is applied to the second electrode, under a state where the gate line turns off the first switch element, to increase the voltage level of the first electrode by the first predetermined voltage in a precharge period, and finally the third switch element is turned on to discharge the first electrode via the third switch element and the fourth switch element in the refresh period, so that the first electrode has a negative voltage level with respect to the second electrode.

* * * * *